United States Patent [19]

Rudd

[11] 4,320,842

[45] Mar. 23, 1982

[54] MAGNETIC SEPARATOR

[75] Inventor: Edward H. Rudd, Wooster, Ohio

[73] Assignee: Magni-Power Company, Wooster, Ohio

[21] Appl. No.: 134,682

[22] Filed: Mar. 27, 1980

[51] Int. Cl.[3] ..... B07C 5/34

[52] U.S. Cl. ..... 209/636; 209/218; 209/625

[58] Field of Search ..... 209/213, 214, 215, 218, 209/225, 228, 229, 625, 627, 636

[56] References Cited

U.S. PATENT DOCUMENTS

| | | | |
|---|---|---|---|
| 9,610 | 3/1853 | Gardiner | 209/229 |
| 673,172 | 4/1901 | McKnight . | |
| 708,185 | 9/1902 | Wetherill . | |
| 2,092,025 | 9/1937 | Sallee . | |
| 2,826,302 | 3/1958 | Scott . | |
| 3,749,240 | 7/1973 | Spears et al. | 209/636 X |

FOREIGN PATENT DOCUMENTS

| | | | |
|---|---|---|---|
| 624224 | 12/1935 | Fed. Rep. of Germany | 209/218 |

*Primary Examiner*—Joseph J. Rolla

*Attorney, Agent, or Firm*—Watts, Hoffmann, Fisher & Heinke Co.

[57] ABSTRACT

A magnetic separator for removing ferrous or other magnetic contaminants from loose, non-magnetic materials comprising a bipartite assembly having two sections, which when joined, define a flow passage having an inlet for receiving material to be processed and an outlet for processed material. Magnetic elements in the form of prongs arranged in a plurality of assemblies, associated with each section, travel through the flow passage in an inter-digitated relationship and capture the magnetic substances in the material. The captured contaminants are released at discharge stations spaced from the outlet, where the prongs are demagnetized. Any material not released, is cleaned from the prong assemblies by brushes located at a cleaning station. The prongs are magnetized by a plurality of magnet assemblies that are transported by a conveyor in synchronism and juxtaposed relation with, the prong assemblies for a portion of their travel. The path of the magnet conveyor diverges from the prong conveyor to achieve demagnetization of the prongs at predetermined locations.

10 Claims, 8 Drawing Figures

MAGNETIC SEPARATOR

BACKGROUND OF THE INVENTION

The present invention relates generally to methods and apparatus for removing magnetic particles and substances from non-magnetic material. More specifically, the present invention relates to method and apparatus for removing magnetic contaminants from reclaimed rubber.

Devices for separating magnetic substances from loose, non-magnetic material have been suggested in the past. These devices generally include magnetic elements which attract and capture magnetic particles carried by the material. One such device is illustrated in U.S. Pat. No. 2,912,106 issued to Martin. The magnetic separator described in this patent includes a collection assembly in which a series of V-shaped prongs are spatially distributed. At least one permanent magnet is pivotally mounted to a side wall of the collection assembly and serves to magnetize the prongs when pivoted to a position immediately adjacent the ends of the prongs. After the material has passed through the collection assembly, a slide is inserted into the housing to close off the outlet and the magnet is pivoted outwardly so that magnetism is no longer induced in the prongs. The collection assembly is then cleaned of the released magnetic particles.

Although the Martin devices work very effectively, the processing of material must be interrupted periodically in order to clean the collection assembly. For this reason alternative devices are desirable for dealing with large volume material flows.

Magnetic separators for continuously separating magnetic substances from loose material have also been suggested, but none have proved totally effective.

One prior suggested magnetic separator includes a conveyor belt reeved around a magnetic pulley. Material is carried by the belt over the pulley. The non-magnetic ingredients fall downwardly off the belt and are collected by a suitable container. The magnetic constituents of the material adhere to the belt under the influence of the magnetic pulley and are carried around the pulley to a discharge station where the magnetic material is released and drops into a separate collecting receptacle.

Another known apparatus includes a rotating drum having a magnetized portion. In operation, material is allowed to cascade over the rotating drum. The non-magnetic components of the material are not influenced by the drum and thus can drop freely into a receptacle or onto another conveyor positioned below the drum. The magnetic constituents however adhere to the drum until it passes beyond the magnetized portion where it then drops into a separate receptacle.

Magnetic separators have also been suggested which include an endless conveyor that transports magnetic elements through the material. These elements are generally magnetized by a stationary magnet when they are passing through the material and thus attract the magnetic particles carried therein. The elements carry the captured particles to a discharge location. The separating efficiency of these suggested devices have not been totally satisfactory to date.

With the advent of steel belted tires, the problem of removing the steel cords in order to reclaim the rubber from these tires has arisen. The conventional magnetic separators described above have not been able to remove a sufficient amount of the steel wire and thus have been found unsuitable for use in the tire reclaiming industry.

SUMMARY OF THE INVENTION

The present invention provides a new and improved method and apparatus for continuously removing magnetic contaminents or constituents from loose or ground non-magnetic material. With the present invention, the operation of the apparatus need not be interrupted to remove the magnetic members for cleaning as is required in some prior art devices. Moreover, the apparatus of the present invention can process material at a relatively high volume flow without sacrificing separation efficiency.

According to one embodiment of the invention, the magnetic separator comprises an assembly that defines a passage through which the material to be processed, travels. Preferably the passage is vertically oriented having an inlet for receiving material at the top and an outlet at the bottom from where the processed material is discharged. By using a vertical orientation for the passage, gravity is utilized to effect material flow and obviates the need for a separate material conveyor.

A plurality of magnetic elements, preferably magnetically permeable prong assemblies, are transported through the passage by an endless conveyor. Preferably, the endless conveyor is formed by a pair of continuous chains and the prong assemblies are attached to and longitudinally spaced along the chains. Each prong assembly comprises a plurality of laterally spaced prongs that extend substantially transverse to the direction of material flow when the prong assemblies are traveling through the passage. The prongs are welded to a support plate that spans the distance between the chains. The ends of the plate are fastened to brackets that are attached to spaced chain links of each chain.

In the preferred embodiment, two prong conveyors are provided, each including a set of prong assemblies. The prong assemblies of one conveyor travel along one wall of the passage; the prong assemblies of the other conveyor travel along an opposed wall of the passage and preferably in a spaced interdigitated relationship with the first set of prong assemblies. Thus the prongs associated with the prong assemblies of the one conveyor pass between the prongs of the assemblies associated with the other conveyor.

In order to magnetize the prongs when the prongs are in the passage, magnets, preferably permanent magnets, are positioned in the vicinity of the passage so that magnetism is induced in the prongs traveling through the passage. As the prong assemblies leave the passage, magnetism continues to the induced for a predetermined distance whereupon the magnets are rendered ineffective and no longer induce magnetism in the prongs. At this juncture, any magnetic material attracted to the prongs is released at a discharge station.

In the illustrated embodiment, the prongs that comprise the prong assemblies are V shaped and tapered. It is believed that this shape balances the magnetic field established about the prongs and enhances the attraction and capture of the magnetic matter and substances entrained in the material being processed. The prongs are mounted in the assembly in an inverted orientation which facilitates the retention of the captured magnetic matter. The non-magnetic materials can cascade over the top surface of the prongs without dislodging the captured matter adhering to the underside of the prongs.

The present invention provides an extremely efficient method and apparatus for extracting magnetic constituents or contaminents from non-magnetic material such as reclaimed rubber. The traveling prong assemblies cause the material to tumble and separate as the assemblies move through the passage, assuring that the magnetic components of the material are exposed to the magnetic force induced in the prongs.

According to a feature of the invention, the magnets for inducing magnetism in the prongs when the prongs are traveling through the passage, are mounted to a magnet conveyor in the form of a pair of chains. The magnet conveyor carries the permanent magnets along an outside wall of the passage, in synchronism and, in juxtaposed relation with, the prong assemblies traveling along the inside surface of the same wall. The magnets remain substantially aligned with an associated prong assembly for a predetermined distance beyond the outlet of the passage so that the magnetic particles attracted to the prongs are carried (by the prongs) to the appropriate discharge station. To effect release of the particles at the discharge station, the path of travel for the magnetic conveyor diverges from the path of travel of the prong assemblies so that magnetism is no longer induced in the prongs. At the inlet to the passage, the magnet conveyor again rejoins the prong conveyor so that the magnets are again brought into synchronism and juxtaposed relation with the prong assemblies as they travel through the passage.

According to another feature of the invention, the apparatus is a bipartite assembly, each section of which, defines a portion of the passage. Each section includes a prong conveyor, a magnet conveyor, and a slider bed defining a sidewall of the passage along which the magnets and prong assemblies travel. This construction allows the unit to be separated to facilitate cleaning and maintenance of the unit or to clear material clogs.

Each section of the assembly includes its own drive means for effecting movement in its associated magnet and prong conveyors. The drive mechanism, preferably comprising an electric drive motor and gear reduction unit, allows the speed of conveyors to be varied and more importantly allows the prong conveyors of the joined sections to travel at a relative speed with respect to each other and at speeds that differ from the material flow rate through the passage. This feature increases material tumbling and separation thereby enhancing magnetic contaminant removal. In the preferred embodiment, the prong conveyors move in a direction substantially parallel to the direction of material flow, albeit at differing speeds. The invention, however, also contemplates conveying the prong assemblies in directions opposite to material flow and operating the prong conveyors in directions opposite to each other.

The present invention also contemplates a magnetic separator in which the prong assemblies are conveyed along a path substantially transverse to the direction of material flow. In this embodiment, the material to be processed is preferably carried by a substantially horizontal conveyor. The prong conveyor and associated magnetic conveyor are supported above the material conveyor and are arranged so that the prong assemblies pass through the material carried by the material conveyor and in a direction transverse to material flow. The path of travel for the magnetic conveyor is arranged so that magnetism is induced in the magnetic prongs as they pass through the material and for a predetermined distance beyond the material conveyor whereupon the magnet conveyor path diverges so that the magnetic components attracted to the prongs are released at a discharge station.

A fuller understanding and additional features of the invention will become apparent in reading the following detailed description made in connection with the accompanying drawings.

DESCRIPTION OF THE PREFERRED EMBODIMENT

Figure 1:
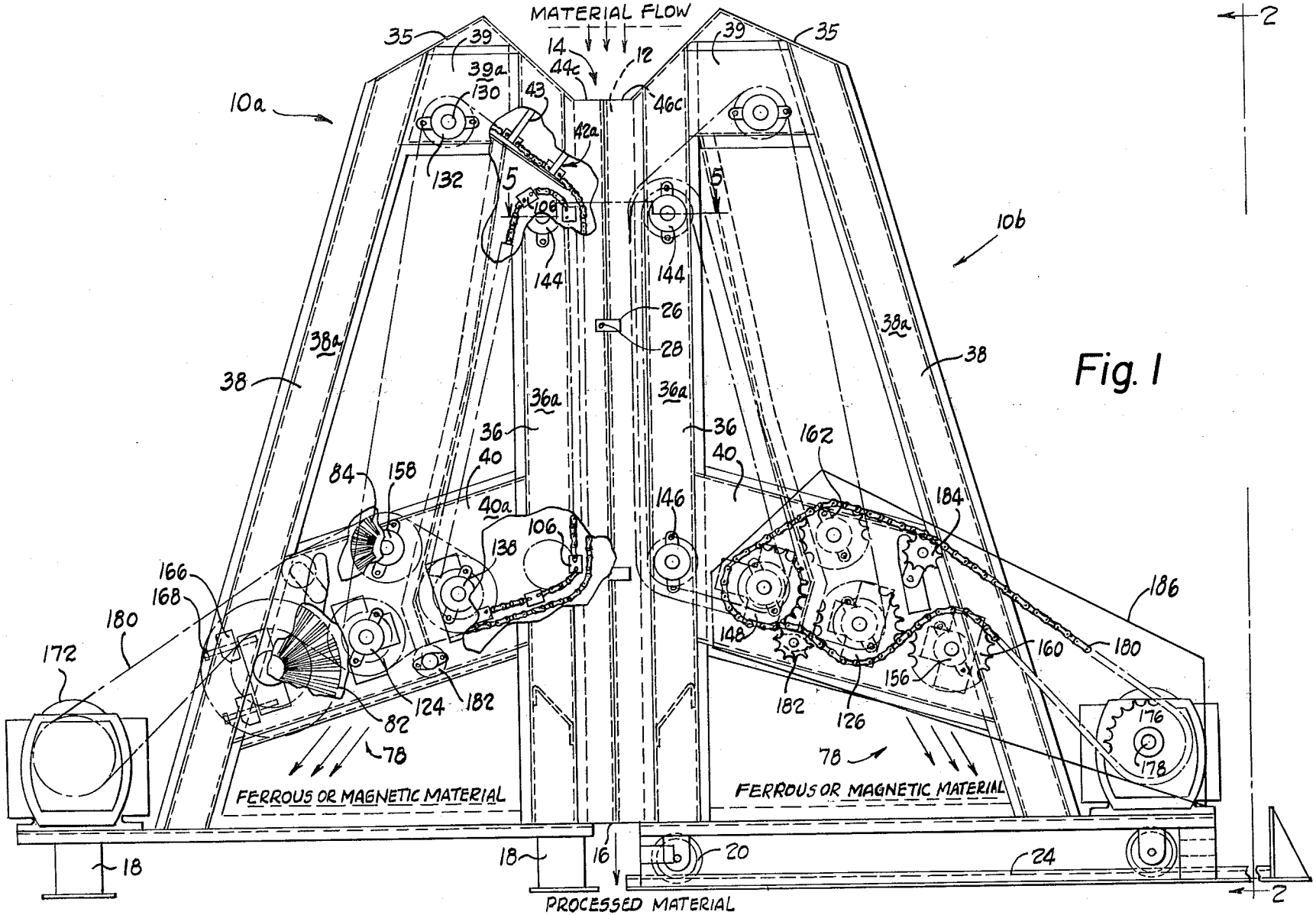
FIG. 1 is a front elevational view of a magnetic separator constructed in accordance with the preferred embodiment of the invention, with portions broken away to show interior features.

FIG. 1 illustrates the overall construction of a magnetic separator embodying the present invention. The separator is preferably a bipartite assembly having left and right sections 10*a*, 10*b* (as seen in FIG. 1) which, when joined together, define a material flow passage 12 having an inlet 14 for receiving material to be processed and outlet 16 from where processed material is discharged.

Magnetized elements, to be described, travel through the passage 12 and attract and capture ferrous or other magnetic substances in the material flowing through the passage. The elements then carry and release the captured substances to discharge stations located to the right and left of the flow passage 12, as viewed in FIG. 1.

Figure 2:
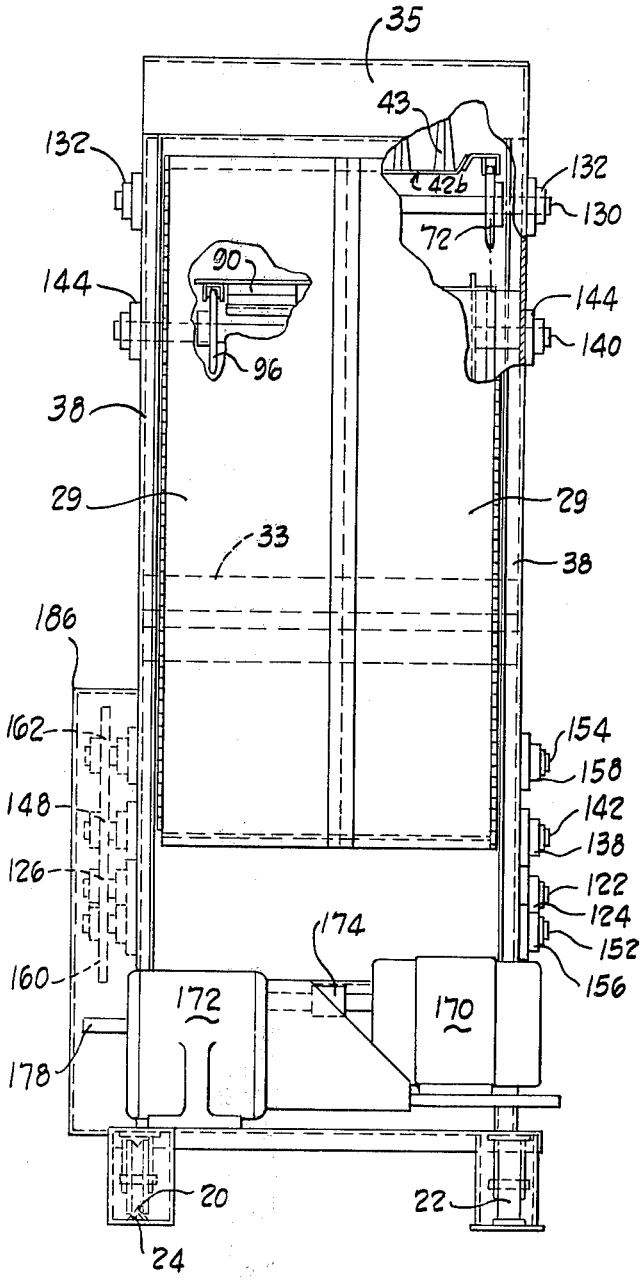
FIG. 2 is a elevational view of the magnetic separator as seen along the line 2—2 in FIG. 1, with portions broken away to show interior details.

The sections 10*a*, 10*b* are substantially identical in construction, the primary difference being the stationary mounting of the section 10*a* versus the movable mounting of the section 10*b*. Referring also to FIG. 2, the section 10*a* rests on support legs 18 and is intended to remain stationary, whereas section 10*b* is supported on casters 20, 22 and thus the section 10*b* is movable with respect to the section 10*a*. The casters 20 are V-shaped and ride on an inverted V-shaped track 24 so that the alignment between the sections 10*a*, 10*b* is not disturbed when the section 10*b* is shifted to the right as seen in FIG. 1. The casters 20, 22 allow the sections 10*a*, 10*b* to be easily separated to facilitate inspection and maintenance of the flow passage 12. Latch plates 26 and suitable fasteners 28 (also shown in FIG. 5) are used to lock the sections 10*a*, 10*b* together. Hinged access doors 29 enclose the sides of each section.

Figure 4:
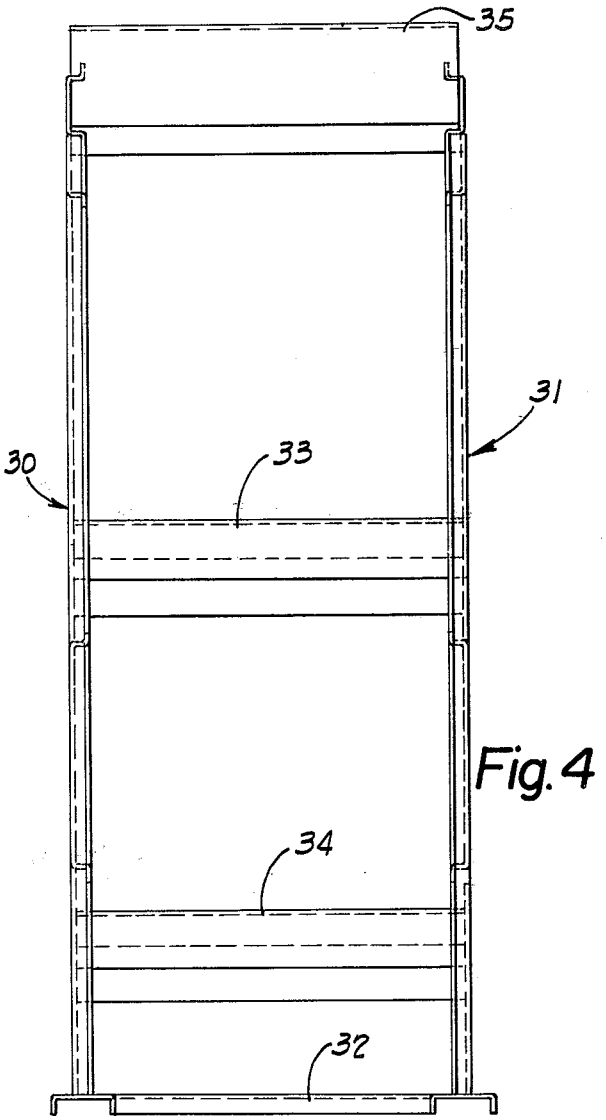
FIG. 4 is a front elevational view of a portion of the support structure for the magnetic separator shown in FIG. 1.
Figure 3:
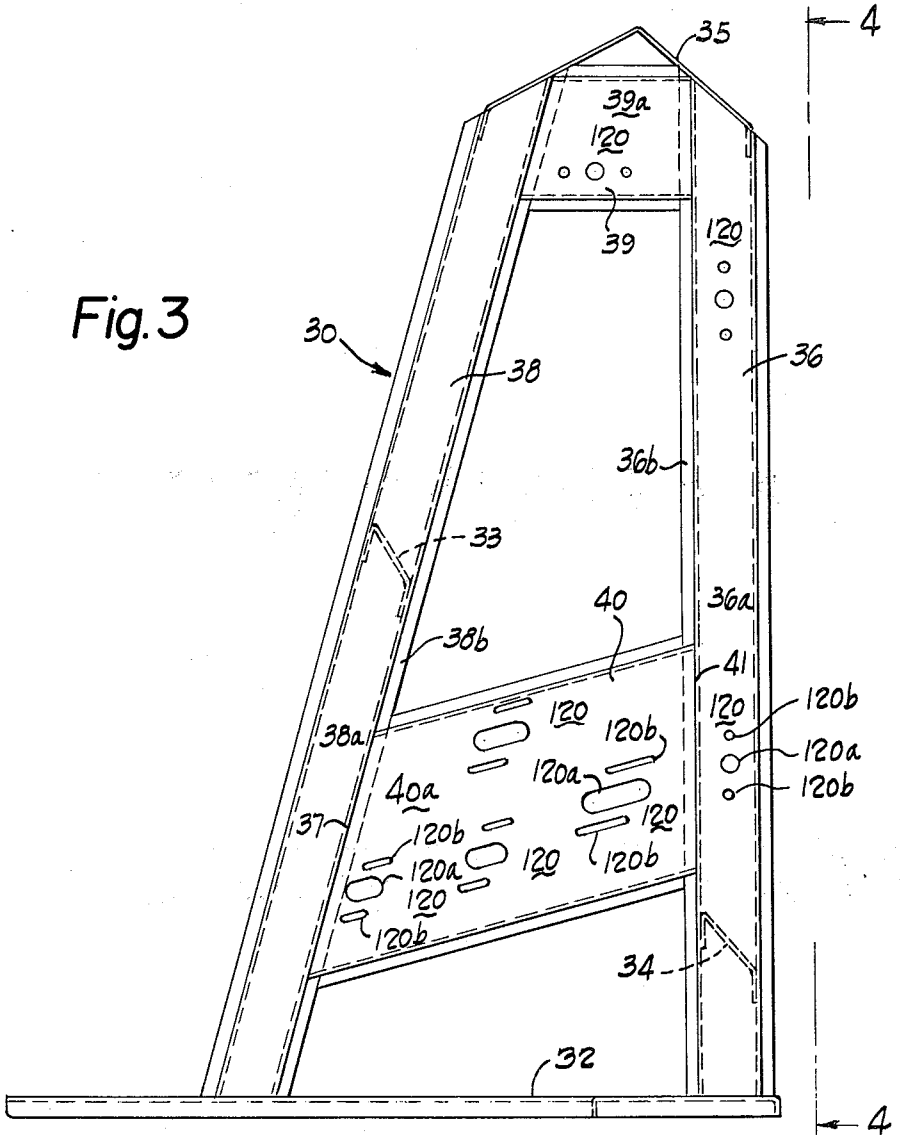
FIG. 3 is a transverse sectional view as seen along the line 3—3 in FIG. 1 with portions omitted for clarity.

Referring to FIGS. 3 and 4, each section 10*a*, 10*b* includes a rigid, welded support structure comprising an upstanding pair of skewed A-frames 30, 31, spaced front and rear (as viewed in FIG. 1) that are welded to a base plate 32. The front and rear A-frames 30, 31 are maintained in spaced alignment by cross-pieces 33, 34, and an angled cover plate 35. The cover plate 35 encloses the top of each section 10*a*, 10*b* and thus also serves as a protective cover.

Each A-frame 30, 31 includes a vertically oriented support channel 36, an angled support channel 38 and upper and lower cross members 39, 40 respectively that extend between and are welded to the support channels 36, 38. The lower cross member 40, is welded to flanges 36*b*, 38*b* of the support members 36, 38 and along a juncture 37 between a channel bridging surface 36*a* and cross member bridging surface 40*a* as well as a juncture 41 between the channel bridging surface 38*a* and the bridging surface 40*a*. When assembled, the surfaces 36*a*, 40*a*, 38*a* are flush.

The upper cross member 39 is similarly mounted to the support channels 36, 38 so that the surfaces 36*a*, 38*a* and cross member bridging surface 39*a* are flush. The cross member and channel bridging surfaces 36*a*, 38*a*, 39*a*, 40*a* mount a plurality of flange bearings which in turn, rotatably support drive shafts and other rotating components that will be described in greater detail further on.

Figure 5:
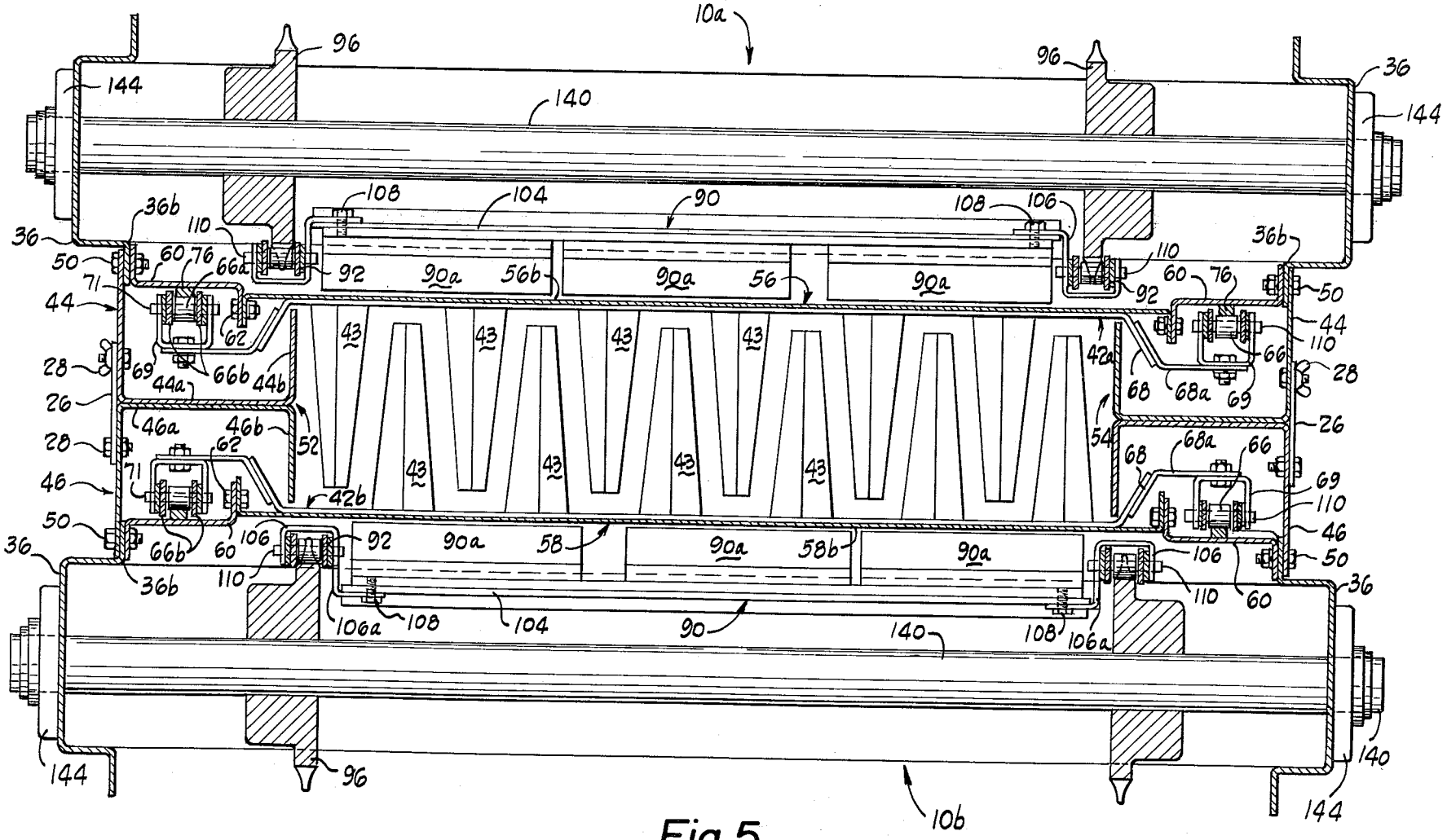
FIG. 5 is a view of a support structure as seen along the line 5—5 in FIG. 4.

Refering now to FIG. 5, a cross sectional view of the flow passage 12 and the apparatus for removing magnetic contaminants from materials that pass through the passage 12 is shown. Material to be processed is introduced into the inlet 14 of the passage 12 (shown in FIG. 1) and travels downwardly until it exits at the outlet 16. As it travels through the passage 12, ferrous or magnetic substances are attracted to and captured by projecting magnetized elements 43 preferably prongs arranged in the form of prong assemblies 42*a*, 42*b*, associated with the sections 10*a*, 10*b*, respectively, that also travel through the passage 12 in an interdigitated relationship.

In the preferred embodiment, each section 10*a*, 10*b* defines one-half of the flow passage 12 and each section includes its own drive mechanism for its associated prong assemblies 42*a*, 42*b*. When the sections 10*a*, 10*b* are joined, a pair of U-shaped channels 44 associated with the section 10*a* abuts a similar pair of U-shaped channels 46 associated with the section 10*b*. The channels 44, 46 are bolted to the flanges 36*b* of the support members 36 in the respective sections 10*a*, 10*b* by fasteners 50. Bridging portions 44*a*, 46*a* of these U-channels 44, 46 form abutting surfaces when the sections 10*a*, 10*b* are joined. The U-channels 44, 46 of the respective sections are maintained in abutting engagement by the latches and fasteners 26, 28. Each of the U-channels 44, 46 include interior flanges 44*b*, 46*b* that together define front and rear walls 52, 54 of the passage 12.

The passage 12 is further defined by opposed sidewalls in the form of slider beds 56, 58 mounted in the sections 10*a*, 10*b* respectively, that extend between the paired U-channels 44, 46 and along which the prong assemblies 42*a*, 42*b* travel as they traverse the length of the flow passage 12. The slider beds 56, 58 are positioned centrally within the respective sections 10*a*, 10*b* and are fastened to the vertical support members 30, by Z-strips strips 60. Each Z-strip 60 includes two angled portions one of which is bolted by fastener 62 to a flange formed on the edge of each slider bed and the other end of which is fastened to the flange 36*b* of the vertical suppport member 36 by the fastener 50.

In the preferred embodiment, the prong assemblies 42*a*, 42*b* are moved along the slider beds 56, 58 by conveyors associated with each section 10*a*, 10*b*. The conveyors each comprise a pair of prong chains 66 to which the prong assemblies 42*a*, 42*b* are attached. As seen in FIG. 3, when the prong assemblies are traveling through the flow passage 12, the chains 66 ride along the Z-strips 60 and are substantially enclosed and protected from the material in the flow passage 12 by the confronting U channels 44, 46. Although not shown, the top ends 44*c*, 46*c* (see FIG. 1) of the U channels 44, 46 are enclosed by cover plates to prevent the entry of material into the area between the flanges of the U channels 44, 46.

Figure 7:
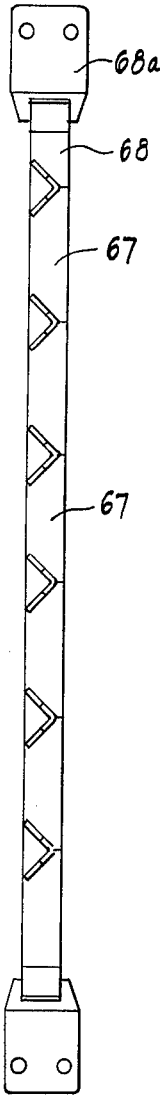
FIG. 7 is an elevational view of the prong assembly as seen along the line 7—7 in FIG. 6; and, FIG. 8 illustrates schematically the construction of the apparatus for removing magnetic contaminants from non-magnetic materials, that forms a portion of the magnetic separator shown in FIG. 1.
Figure 6:
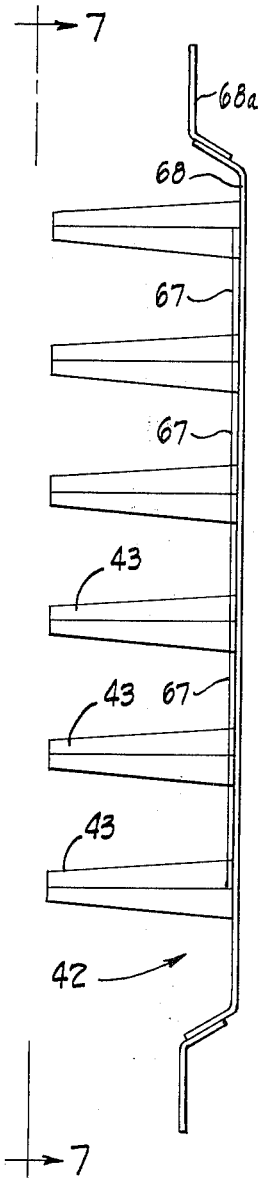
FIG. 6 is a top elevational view of a prong assembly constructed in accordance with the preferred embodiment of the invention.

The prong assemblies 42*a*, 42*b* are identical in construction and to facilitate the description will be referred to by the reference character 42 when describing them in generic terms. The construction of a prong assembly 42 is detailed in FIGS. 6 and 7. Each assembly 42 comprises a plurality of inverted V-shaped prongs 43 welded to a support plate 68 at spaced locations and which extend othagonally therefrom. Reinforcing plates 67 are fastened to the support plate 68 between adjacent prongs to further rigidize the assembly 42. The support plate 68 includes angled ends that are welded to angled mounting plates 68*a*. Each of the mounting plates 68*a* includes a pair of apertures which accept threaded fasteners that mount the prong assembly 42 to chain brackets 69 (see FIG. 3) spaced along the chain. The chain brackets are attached to certain chain links by hinge pins 71.

The prongs 43 are constructed of a ferromagnetic (magnetically permeable) material such as hot rolled steel, so that the prongs will become magnetized when in the vicinity of a magnetic source. In order to inhibit the attraction or adherence of magnetic substances to non-prong areas of the assemblies 42, the support and mounting plates 68, 68*a*, and the reinforcing plates 67 are constructed of a non-ferric stainless steel, one such material being known as "304 stainless".

In the illustrated embodiment, the prongs 43 are V shaped and tapered along their longitudinal extent, with the base of the prong being wider than the tip. As seen in the drawings, the edges of contiguous, oppositely extending prongs are parallel. It is believed, that this configuration balances the magnetic field between the opposed prong assemblies 42*a*, 42*b* and that the induced magnetism in the individual prongs is enhanced.

Paramagnetic materials such as the above mentioned "304 stainless" as well as aluminum are preferably used throughout the magnetic separator to minimize the retention or communication of magnetism. For this reason, in the preferred embodiment, the A-frames 30, 31; the channels 44, 46; the chains 66; the chain brackets 69; and the slider beds 56, 58 are all constructed from non-ferric stainless steel.

Figure 8:
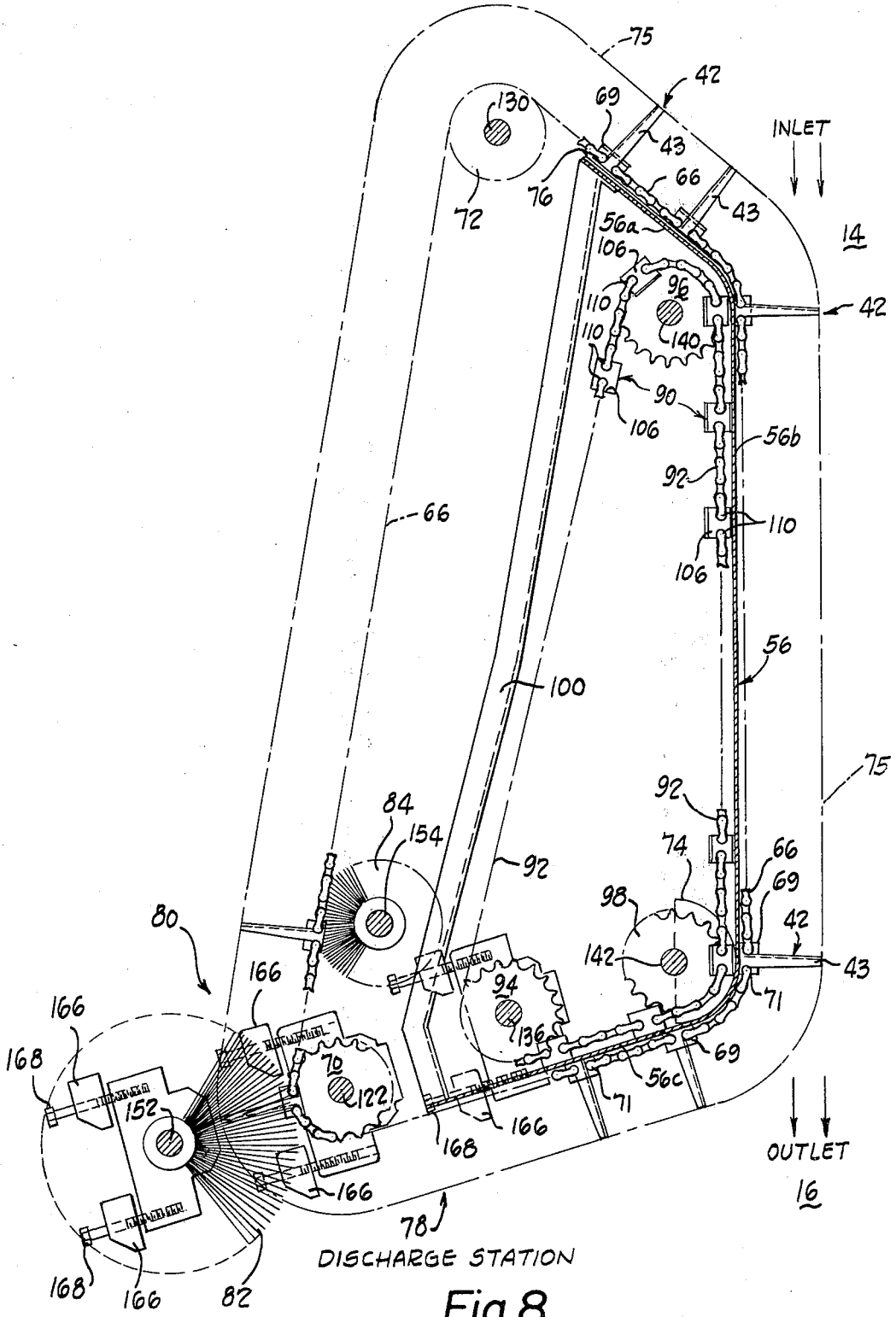

Turning now to FIG. 8, the method and apparatus for removing magnetic particles from materials travelling through the passage 12, is illustrated. It should be understood that the construction and configuration of the mechanism for removing the magnetic particles is the same for both sections 10*a*, 10*b*. For purposes of explanation, the mechanism shown is oriented as it would appear in the section 10*a*.

The travel path for the pair of prong chains 66 that support and transport the prong assemblies 42 in a section 10*a* is defined by a drive sprocket 70, an idler sprocket 72 and the slider bed 56. The slider bed 56 includes an upper leg 56*a*, vertical, intermediate leg 56*b* that forms the side wall of the passage 12 (shown in FIG. 5) and a lower leg 56*c* that carries the prongs 42 out of the flow passage 12. (The slider bed 58 of the section 10*b* includes similar legs.) The slider bed raii between the slider bed legs 56*a*, 56*b* and between the legs 56*b*, 56*a* are supportively defined and are attached to upper and lower conforming, semi-cylindrical track mounts which in turn are fastened to the A-frames 30, 31. Only the lower track mount 74 is shown in FIG. 8.

In the preferred construction, the chains 66 ride on track surfaces formed by stainless steel elongated bars 76 (see also FIG. 3) fastened to the slider bed 56 along its entire extent and conforming to its contour. Specifically, the rollers 66*a* of the chain 66 roll on the top surface of the track while the link plates 66*b* ride along the side surfaces of the track and thus the lateral position of the chains 66 is fixed. The travel path for the pair of prong chains 66 in the section 10*b* is substantially identical to that described above except they travel along the slider bed 58.

The prong assemblies 42 are preferably conveyed downwardly along the flow passage 12 although movement in the opposite direction is contemplated by the present invention. The preferred prong assembly travel path is designated by the phantom line 75. As the prong assemblies 42 travel along the vertical slider bed portions (56*b* in the section 10*a*, 58*b* in the section 10*b* shown in FIG. 5), the prong assemblies are magnetized and thereby attract and capture any magnetic particles or substances carried in the material flowing through the flow passage 12. Near the outlet 16 of the flow passage 12, the slider beds 56, 58 diverge laterally from the path of material flow and conduct the prong assemblies 42 via the lower slider bed legs (element 56*c* in the section 10*a*, the lower leg of the slider bed 58 is identical but not shown) to a discharge station, indicated generally by the reference character 78 where the prong assemblies 42 are de-magnetized and any captured magnetic particles are thus released. The prong assemblies associated with each section 10*a*, 10*b* 42 then travel around the associated drive sprocket 70 to a cleaning station 80 where a pair of brushes 82, 84 clean the front and back of the prong assemblies 42 of any remaining magnetic material that was not released at the discharge station. The prong assemblies 42 then move upwardly and around the idler sprocket 72 from where they then reenter the flow passage 12 along the upper leg 56*a* of the slider bed 56.

As the prong assemblies 42 travel along the vertical slider bed portion 56*b*, they are magnetized by permanent magnet assemblies 90 positioned along an outside wall of the slider bed portion 56*b*, immediately adjacent the prong assemblies 42*a* traveling through the flow passage 12. Although stationary magnets are contemplated by the present invention, in the preferred embodiment the magnet assemblies 90 are carried by a magnet conveyor in the form of a pair of chains 92 (see FIG. 3) which is co-driven with the prong conveyor so that the magnets 90 move in synchronism and in juxtaposed relation with the prong assemblies 42*a* traveling through the flow passage. In this way, magnetic induction in the prong assemblies 42 is maximized.

The magnet conveyor chains 92 are reeved around a drive sprocket 94, and two idler sprockets 96, 98. A flanged back panel 100 extends between the sections 56*a* and 56*c* of the slider bed, thereby defining an enclosed chamber in which the magnet conveyor operates. When the unit is mounted in the section 10*a*, front and back side, non-ferric panels not shown, fully enclose the magnetic conveyor chamber and inhibit the entry of dirt, dust, etc.

According to the invention, the magnetic conveyor path is positioned immediately adjacent the slider bed portions 56*b*, 56*c* so that the prong assemblies 42*a* are magnetized as they travel through the passage 12 and for a predetermined distance beyond the outlet 16. This insures that any magnetic contaminants or substances captured by the prongs 43 are carried from the flow path and well beyond the outlet area. The magnetic conveyor path then diverges from the prong conveyor path so that the prongs are de-magnetized as they leave the slider bed portion 56*c* thereby releasing the captured magnetic particles at the discharge station 78. Any remaining particles adhering to the prongs due to residual magnetism, etc., are removed at the cleaning station 80 by the brushes 82, 84. The magnetic conveyor rejoins the travel path of the prong assemblies 42 just prior to entering the flow passage 12 and thus magnetism is re-induced in the prongs 43 as they enter the passage.

Once magnetic matter is captured by the prongs 43 the inverted "V" orientation facilitates the retention of the matter held by the prongs. The captured particles tend to migrate to the underside of the prongs and thus are shielded from the non-magnetic material flowing through the passage 12. As a prong assembly 42 leaves the flow passage 12 along the radius that joins the slider bed portions 56*b*, 56*c*, the exiting, processed material can cascade over the upper surfaces of the prongs 43 without dislodging the captured magnetic matter adhering to the underside of the prongs.

Referring to FIG. 3, each magnet assembly 90 comprises a plurality of permanent preferably ceramic magnets 90*a* that are attached to a mounting plate 104. Chain brackets 106 that include an integral, angled plate 106*a* are fastened directly to the mounting plate by suitable fasteners 108. The chain brackets 106 like the prong chain brackets 69 are attached to the chains by hinge pins 110 at spaced, equidistant locations.

The components that make up the prong and magnet conveyors in each of the sections 10*a*, 10*b* are mounted and supported between the front and rear A-frames 30, 31 of the respective sections. Referring to FIG. 4, flange bearings are mounted to the channel bridging surface 36*a* and the cross member bridging surfaces 39*a*, 40*a* at locations indicated by the reference character 120. Note that in the case of the mounting 120 in the upper cross member 39, the smaller apertures 120*b* are positioned to the side of the large aperture 120*a*. Each location includes a large aperture 120*a* and two smaller apertures 120*b* disposed above and below the larger aperture 120*a*. The larger aperture 120*a* provides a clearance for a drive shaft rotatably supported by the flange bearing mounted at that location while the smaller apertures accept fasteners that attach the associated flange bearing to the surface. The mounting locations in the cross member surface 40*a* are slotted to provide an adjustable mounting for the flange bearings mounted thereon.

Referring also to FIGS. 1–3 and 8, the drive sprockets 70 that drive the chains 66 in a given section 10*a*, 10*b*, are mounted to a drive shaft 122 that is rotatably supported by a pair of flange bearings 124 mounted on opposite cross member bridging surfaces 40*a*. A primary drive sprocket 126 (shown in FIG. 1) is mounted to the outer most end of the drive shaft 122.

The idler sprockets 72 are mounted to a common drive shaft 130 which is rotatably supported by a pair of flange bearings 132 that are bolted to opposite cross member bridging surfaces 39*a* of the upper cross members 39.

The drive sprockets 94 for the magnetic conveyor are mounted to a common shaft 136 which in turn is rotatably supported by a pair of flange bearings 138 mounted to opposite cross member bridging surfaces 40*a* of the lower cross member 40. The idler sprockets 96, 98 for the magnetic conveyor are mounted to common shafts 140, 142 which are rotatably supported by pairs of flange bearings 144, 146 that are fastened to the bridging surface 36*a* of the vertical support members 36. A primary drive sprocket 148 (see FIG. 1) is mounted to the outward end of the drive shaft 136.

The cleaning brushes 82, 84 are mounted on drive shafts 152, 154 which are rotatably supported by pairs of flange bearings 156, 158 that are bolted to opposed cross member bridging surfaces 40*a* of the lower cross member 40. Primary drive sprockets 160, 162 are attached to the front ends of the drive shafts 152, 154.

As noted earlier, the positions of certain flange bearings are adjustable. Specifically, referring to FIG. 8, the positions of the flange bearings 156 124, 138 that support the cleaning brush 82, the drive sprockets 70 and the drive sprockets 94 are provided with the adjustments in the form of threaded blocks 166 and jack bolts 168. The positions of the components are varied by turning the jack bolts 168 into or out of the stationary adjusting blocks 166.

Referring to FIG. 1 and 2, the prong and magnet conveyors in each section 10*a*, 10*b* are co-driven by a primary chain drive associated with each section, comprising an adjustable electric drive motor 170, the output of which is coupled to a speed reduction unit 172 through a flexible coupling 174. A drive sprocket 176 is attached to an output shaft 178 of the speed reducer and drives a primary drive chain 180 that is linked to the primary drive sprockets 126, 148, 160, 162. An idler sprocket 182 is mounted to the cross member bridging surface 40*a* and is located between the primary drive sprockets 126, 148 and increases the chain wrap around these drive sprockets. A chain tensioner 184 is also provided to adjust the tension of the primary chain 180. A chain guard 186, preferably encloses the entire primary chain drive in each section 10*a*, 10*b*.

Although not shown, in the preferred system, the flange bearings and the various chains are lubricated by a conventional automatic lubricating system that pumps lubricant to the bearings and includes chain oilers (not shown) mounted at various locations in contact with the chains.

As noted above, the prongs 43 of the prong assemblies 42*a* associated with the section 10*a* travel between the prongs 43 of the prong assemblies 42*b* associated with the section 10*b*, when the assemblies are traveling through the flow passage 12. This interposed movement of the prongs promotes material tumbling and separation in the passage 12 and thus enhances the separation of magnetic contaminants from non-magnetic materials for it maximizes the exposure of the magnetic contaminants to the magnetic attraction of the prongs. To further enhance separation and material tumbling, the prong assemblies 42*a* 42*b* of the sections 10*a*, 10*b* are driven at differing speeds by appropriate adjustment of the respective drive motors. Thus, the prong assemblies 42*a* move relative to the prong assemblies 42*b* as they travel through the flow passage 12 and thus the vertical spacing between the opposed prong assemblies 42*a*, 42*b* changes as the assemblies travel through the passage 12.

The ability to vary the relative speeds of the prong conveyors is an important feature of the invention. The disclosed method and apparatus for conveying the prong assemblies 42*a*, 42*b*, enable the assemblies to travel at speeds that differ from the rate of material flow through the flow passage 12. In fact, the prong assemblies 42*a*, 42*b*, can be driven in a direction opposite to the material flow or opposite to each other. For instance, the assemblies 42*a* can be conveyed downwardly along the passage 12 while the assemblies 42*b* are conveyed upwardly. Again, a differential speed between material flow and the prong assemblies promotes separation and tumbling of the material as it travels through the flow passage.

The speed adjustability of the prong assemblies coupled with the ability to move them relative to each other and relative to the speed of the material flow, makes the disclosed apparatus and method especially suited for use in the rubber reclaiming industry. In this application, tire carcasses are first ground or shredded. The resulting "mulch-like" material is then introduced at the inlet 14 from where it travels downwardly through the flow passage 12 finally exiting at the outlet 16. As the material travels through the passage, the extending prongs 43 of the opposed assemblies 42, 42*b*, tumble and separate the ground material and capture any ferrous or magnetic substances, such as steel and fragments, particles, etc. entrained in the material. The captured substances are then released at the discharge stations 78.

Although the invention has been described with a certain degree of particularity, various changes can be made to it by those skilled in the art without departing from the spirit or scope of the invention as described and hereinafter claimed.

What is claimed is:

1. A magnetic separator, comprising:

(a) structure forming a passageway that defines a flow path for material to be processed;

(b) a plurality of spaced, magnetically permeable elements movable along at least one inside wall of said passageway, said elements extending substantially transverse to the direction of the material flow;

(c) first conveyor means comprising an endless chain to which the elements are attached, for transporting said elements through said passageway, along said inside wall;

(d) magnetic means for inducing magnetism in said elements, said magnetic means movable along an outside wall of said passageway, in juxtaposed relationship with said elements;

(e) second conveyor means comprising an endless chain to which the magnetic means is attached, for moving said magnetic means in synchronism with said elements; and, (f) drive means for driving said conveyors.

2. The magnetic separator of claim 1 wherein said structure forming said passageway comprises contiguously positioned subsections, each subsection defining a portion of said passage and including the plurality of spaced magnetically permeable elements movable along an associated inside wall, first and second conveyor means, and said magnetic means.

3. The apparatus of claim 1 wherein said elements comprise prong assemblies, each assembly including a plurality of spaced V-shaped elongate prongs.

4. A magnetic separator for continuously removing magnetic constituents from nonmagnetic materials, comprising:

(a) a bipartite assembly defining a passage when the sections of said assembly are joined, said passage including an inlet for receiving materials to be processed and an outlet for discharging processed material;

(b) each section of said assembly including a slider bed defining a wall of the passage;

(c) a plurality of longitudinally spaced prong assemblies associated with each section, supported for movement along the associated slider bed by an endless conveyor;

(d) each section of said assembly further including magnetic means for inducing magnetism into said prong assemblies when the prong assemblies are traveling along said slider bed; and (e) drive means associated with each section of said assembly for driving said conveyors, said drive means operative to drive the endless conveyors at differing linear speeds.

5. The magnetic separator of claim 4 wherein the prong assemblies of one section travel in an interdigitated relationship with the prong assemblies of the other section when the two sections are joined.

6. The magnetic separator of claim 4 wherein said magnetic means comprises a plurality of magnets supported for synchronous movement with said prong assemblies along an outer surface of said slider bed, said magnets being in juxtaposed relationship with the prong assemblies traveling through the passage.

7. The apparatus of claim 4 wherein said prong assemblies comprise a plurality of elongate, tapered prongs mounted in spaced alignment to a support plate.

8. A magnetic separator for continuously removing magnetic constituents from nonmagnetic materials, comprising:

(a) a bipartite assembly defining a passage when the sections of said assembly are joined, said passage including an inlet for receiving materials to be processed and an outlet for discharging processed material;

(b) each section of said assembly including a slider bed defining a wall of the passage;

(c) a plurality of longitudinally spaced prong assemblies associated with each section, supported for movement along the associated slider bed by an endless conveyor;

(d) each section of said assembly further including magnetic means for inducing magnetism into said prong assemblies when the prong assemblies are traveling along said slider bed; and (e) drive means associated with each section of said assembly for driving said conveyors, said drive means operative to drive the prong assemblies of at least one of the sections through said passage at a speed different from the material flow rate through said passage.

9. A magnetic separator for continuously removing magnetic constituents from nonmagnetic materials, comprising:

(a) a bipartite assembly defining a passage with the sections of said assembly are joined, said passage including an inlet for receiving materials to be processed and an outlet for discharging processed material;

(b) each section of said assembly including a slider bed defining a wall of the passage;

(c) a plurality of longitudinally spaced prong assemblies associated with each section, supported for movement along the associated slider bed by an endless conveyor;

(d) each section of said assembly further including magnetic means for inducing magnetism into said prong assemblies when the prong assemblies are traveling along said slider bed; and (e) drive means associated with each section of said assembly for driving said conveyors, said drive means operative to drive the prong assemblies associated with at least one of the sections through said passage in a direction opposite to the material flow direction.

10. A magnetic separator for continuously removing magnetic constituents from nonmagnetic materials, comprising:

(a) a bipartite assembly defining a passage when the sections of said assembly are joined, said passage including an inlet for receiving materials to be processed and an outlet for discharging processed material;

(b) each section of said assembly including a slider bed defining a wall of the passage;

(c) a plurality of longitudinally spaced prong assemblies associated with each section, supported for movement along the associated slider bed by an endless conveyor;

(d) each section of said assembly further including magnetic means for inducing magnetism into said prong assemblies when the prong assemblies are traveling along said slider bed; and (e) drive means associated with each section of said assembly for driving said conveyors, said drive means operative to drive the prong assemblies associated with one section in a direction opposite to the prong assemblies associated with the other direction.

* * * * *